US005117222A

United States Patent [19]

McCurdy et al.

[11] Patent Number: 5,117,222

[45] Date of Patent: May 26, 1992

[54] TAMPER INDICATING TRANSMITTER

[75] Inventors: Jim McCurdy, Middletown; Frank Pennypacker, Loveland, both of Ohio

[73] Assignee: Guardian Technologies, Inc., Cincinnati, Ohio

[21] Appl. No.: 634,452

[22] Filed: Dec. 27, 1990

[51] Int. Cl.[5] ..... G08B 21/00

[52] U.S. Cl. ..... 340/573; 340/539; 340/568; 340/572; 379/38

[58] Field of Search ..... 340/573, 568, 572, 539; 379/38

[56] References Cited

U.S. PATENT DOCUMENTS 4,630,035 12/1989 Stahl et al. ..... 340/539
4,630,289 12/1989 Wren ..... 375/71
4,924,211 5/1990 Davies ..... 379/38
4,980,671 12/1990 McCurdy ..... 340/568

*Primary Examiner*—Glen R. Swann, III
*Attorney, Agent, or Firm*—Wood, Herron & Evans

[57] ABSTRACT

A tamper-indicating transmitter is disclosed that indicates a subsequent tamper event during a tamper alert period, T, which is initiated by a first tamper event. In a preferred embodiment, the transmitter includes a transmitter housing having a conductive strap attached thereto for securing the transmitter about a confinee's limb, the confinee typically participating in a home arrest program. Within the housing, a clock source generates pulses having a period t that are input to a counter whose reset line is connected to the conductive strap. When the conductive strap is opened, the counter is held reset and its output is a predetermined multiple bit maximum. Upon the closing of the strap, the counter counts the clock pulses and decrements the counter output from the initial predetermined maximum count down to a predetermined minimum count which remains on the counter output if no subsequent opening of the strap occurs. The counter output is combined with an identification code and is serially provided to a digital/RF converter which transmits a data message containing the counter output and an identification code to a monitoring unit that relays the status of the transmitter to supervisory personnel at a central monitoring station. The counter output is used by the monitoring unit to compute a time a strap closure so a tamper by the confinee during the tamper alert period following securement of the transmitter to the confinee can be distinguished from the strap opening and closing at the transmitter installation.

21 Claims, 6 Drawing Sheets

TAMPER INDICATING TRANSMITTER

FIELD OF THE INVENTION

The present invention relates to portable transmitters and monitoring units used in home arrest systems.

BACKGROUND OF THE INVENTION

Transmitters which can be attached to or worn by a person so the person may be detected within a monitored area are well known. Such transmitters are usually encased within a housing having a strap attached thereto by which the transmitter is secured about a limb or other body part of the person. A monitoring unit is provided within the monitored area to receive a transmitted signal or message from the transmitter and the monitoring unit generates an alarm when the signal from the transmitter is no longer received. The transmitter usually includes an identification code in the transmitted message to make it more difficult for the confinee to use a second transmitter to provide the signal to the monitoring unit when the confinee leaves with the transmitter strapped to his limb.

When the monitored area is a residence which is not typically secured by guards or limited access devices, a device which detects and indicates removal of, or tampering with, the transmitter is needed. Otherwise, the confined person could remove the transmitter, leave it within the monitored area and escape from the area without his absence being detected. A transmitter which provides a removal or tamper-indicating signal to the monitoring unit is shown in U.S. patent application No. 07/343,814 entitled "Remote Confinement System With Timed Tamper Detection Reset," filed on Apr. 26, 1989 and is assigned to the assignee of the present application. The entire disclosure of the referenced application is herein expressly incorporated by reference.

The transmitter of the referenced application has a circuit which monitors the current through a conductive strap used to secure the transmitter to the confinee to detect tampering with the strap. When the current is no longer sensed due to tampering, such as cutting the strap or disconnecting the housing from the strap, a tamper-indicating bit is set and transmitted in a message to the monitoring unit. The transmitted message continues to include the set tamper-indicating bit until a predetermined time period has elapsed following detection of the tamper event. At the expiration of the predetermined time period, the tamper-indicating bit is reset and transmitted in subsequent messages to the monitoring unit to thereby indicate a "no tamper" condition. When the monitoring unit receives a message containing a set tamper-indicating bit, it determines whether an alarm should be sent to a central monitoring station manned by supervisory personnel. If an alarm is sent to the central monitoring station, the supervisory personnel report the alarm to the officer responsible for the confinee, such as a parole officer or the like.

While verifiable confinement of an individual within his home reduces government expenses since housing and guards are not required, it is preferable that the home arrest system also permit the confinee to leave the monitored site to go to his job. Such a system has the social advantage of allowing the confinee to provide for himself and his family.

At work, while out of range of the monitoring unit, the confinee may cause a tamper event by removing the transmitter from his limb since the strap must be opened to effect removal. Such a tamper event occurring at the workplace goes undetected by the monitoring unit at the monitored site. Upon return to the monitored site, the confinee could leave the detached transmitter with the strap closed in the monitored area so the monitoring unit begins to receive transmissions from the detached transmitter (with closed strap). The confinee may now leave the monitored area without detection. The transmitter of the above referenced patent application prevents this from occurring by latching the tamper indicating bit in the set state for a predetermined time which is long enough to provide a tamper-indicating message to the monitoring unit upon the return of the individual to the monitored site following an excused absence, that is, for a period of time which exceeds the permissible length of the excused absence interval. In a preferred version of the referenced transmitter, this time period, i.e., herein termed the "tamper alert period," is approximately 18 hours.

Unfortunately, such a lengthy tamper alert period presents a problem when the transmitter is initially secured to the individual. At the time of initial installment of the transmitter on the confinee at the monitored site, the strap is opened and then closed about the individual's limb resulting in the periodic transmission of messages containing a set tamper-indicating bit to the monitoring unit for the entire tamper alert period. In the home arrest system of the referenced transmitter, the monitoring unit ignores the receipt of the set tamper-indicating bit in the transmitted messages and does not relay tamper messages to a central monitoring station for a second time period. The monitoring unit initiates this second time period which is longer than the tamper alert period following the initial powering of the monitoring unit which is usually close in time to the powering of the transmitter. If the strap is closed at the expiration of the tamper alert period, the transmitter transmits messages containing a reset tamper-indicating bit and the monitoring unit terminates the timing of the second time period. If the monitoring unit receives a transmitted message thereafter containing a set tamper-indicating bit, it sends an alarm to the central monitoring station. If the confinee cuts the conductive strap and leaves it in the monitored area while the first and second time periods are being timed, the transmitted tamper-indicating messages are ignored by the monitoring unit until the expiration of the second time period. Upon receipt of the next tamper-indicating message, the monitoring unit generates an alarm in response to the tamper-indicating messages. This gives the confinee an opportunity to leave the monitored area without detection during the second time period.

If the tamper alert period and second time period are shortened so both time periods expire before the installing officer leaves within a relatively short time, then a tamper during an excused absence, such as a work period, would go undetected because the transmission of messages containing the set tamper-indicating bit caused by the tamper at the work place would terminate prior to the return of the confinee to the monitored site. A transmitter that can be worn by a confinee is needed which indicates an unauthorized tamper just following securement of the transmitter to the confinee, yet provides a tamper indication for a period of time sufficient to provide detection of tampering during excused absences from the monitoring site. Such a transmitter would eliminate the need for the second period in the monitoring unit which prevents transmission of tamper messages to the central monitoring station following installation.

As disclosed in the incorporated patent application, another solution to this limitation has been the use of external reset devices which reset the tamper-indicating circuit when brought in proximity to the transmitter. Access to such manual reset devices must be closely monitored to prevent the device or a duplicate from being obtained by someone who would use it to prevent the monitoring unit from detecting a tamper with the transmitter.

Another limitation of home arrest systems arises from the varying sizes of the houses in which the confinees live. Affluent confinees, such as pre-trial detainees who are major drug dealers, may have homes that cover several thousand square feet of area. Other confinees who are poorer may live in houses or apartments having substantially less than one thousand square feet. If a single range transmitter having a range sufficient to only cover the smaller house is used in a large house, certain areas of the larger home are beyond the monitored area. As a consequence, in a large home the monitoring unit generates an alarm when the confinee leaves the "effective" monitored area and ventures into an unmonitored area of the home. For example, if the den is in the monitored area of a large home and the bedroom is not, then leaving the den and retiring to the bedroom would generate an alarm. Conversely, should the transmission range of the transmitter be sufficient to cover a large house, a confinee within a much smaller home would be able to go to a nearby street or residence, which usually violates the terms of the home arrest, without the monitoring unit generating an alarm. What is needed is a transmitter having a transmission range that can be adjusted to the size of the monitored area at the time it is secured to the confinee's limb and can indicate attempts by the confinee to alter the transmission range thereafter.

SUMMARY OF THE INVENTION

It is an object of the present invention to provide a transmitter for a home arrest system which can detect and report transmitter tampering during the tamper alert period following the securement of the transmitter to the confinee without requiring external auxiliary equipment that must be access guarded.

It is an object of the present invention to permit adjustment of the transmission range of the transmitter to tailor it to the size of the confinee's home or apartment while indicating alteration of the transmission range following securement thereof to the confinee's limb or other body part.

According to the principles of the present invention, a transmitter is provided having a strap connected to a housing which contains the components of the transmitter. A clock within the housing provides a timing signal of clock pulses, each having a period of "t", to a counter. The counter is also connected to a tamper-indicating circuit which detects a tamper with the strap such as an opening of the strap. The tamper-indicating circuit controls the output of the counter. When the tamper-indicating circuit detects an opening of the strap, the counter ignores the clock pulses and its output remains at a predetermined initial count. Upon the closing of the strap, the tamper-indicating circuit enables the counter to begin counting the clock pulses and the counter output decrements from the predetermined initial count toward a predetermined minimum count. The time period measured by the counter counting down to the minimum count from the initial count defines a tamper alert period "T" during which the counter output at any given instant represents an approximate elapsed time from the last closing of the strap. If the strap remains closed following installation on a confinee's limb, the counter output reaches the predetermined minimum count and remains there. Opening the strap during the counting of the clock pulses or after the minimum count is reached, resets the counter output to the initial count and closing the strap causes the counter to again count down from the initial value. A radio frequency converter within the housing periodically transmits a message containing the counter output and an identification code stored in memory, also located within the housing, through an antenna at least once each period t.

A monitoring unit located within the monitored area receives the counter output and identification code in the transmitted message as long as the monitoring unit remains within the transmission range of the transmitter secured to the individual. The monitoring unit confirms that a particular confinee is within the monitored area as long as the identification code in the transmitted message is equivalent to a reference identification code associated with that individual which is stored within the monitoring unit.

At the time of securement of the transmitter to the confinee, an officer remains within the monitored area to observe the individual wearing the transmitter for at least one period t of the timing signal following the closing of the strap. This permits the monitoring unit, following the closing of the strap, to receive at least one transmitted message containing a counter output having a value one less than the initial count that was transmitted while the strap was opened. The monitoring unit calculates the approximate time of strap closing, which is provided to the supervisory personnel at the central monitoring station for their report.

The monitoring unit initializes a counter with the counter output received in the transmitted message and begins counting down clock pulses having a period of t. The output of this counter within the monitoring unit forms an expected counter output which the monitoring unit uses to determine whether the transmitted messages indicate a new tamper. If a tamper event occurs, even during the tamper alert period following any previous tamper, the counter output returns to the initial count and begins counting down when the strap is closed. The monitoring unit compares the counter output in the transmitted message to the expected counter output and generates an alarm when the transmitted counter output is greater than the expected count output. The alarm message and new time of tamper are provided to the supervisory personnel.

The new tamper time can be used to distinguish different tamper events occurring during a single tamper alert period so the officer can identify the confinee's attempt to remove the transmitter after installation. If the strap remains closed for the entire tamper alert period T following installation, the transmitted message contains a counter output having the predetermined minimum count which the monitoring unit identifies as a "no tamper" indication. Thereafter, when the monitoring unit receives a transmitted message having a counter output greater than the predetermined minimum count, it generates a tamper alarm message with a new time of strap closure if the counter output in the transmitted message is less than the initial count. If the counter output in the transmitted message is the initial count, a tamper message without a time of strap closure is generated since the initial count represents an open strap condition.

When the confinee leaves on an excused absence, such as for work, the monitoring unit sends a message to the central monitoring station indicating the transmitter is no longer within the monitored area. The central monitoring station then determines if the time coincides with an excused absence period, t'. If it doesn't, an alarm is generated to alert the supervisory personnel; otherwise no alarm is generated. If the confinee does not return to the monitored area with the transmitter secured about him before the expiration of the excused time period t', the central monitoring station generates an alert to the supervisory personnel who inform the officer responsible for the confinee, who can begin an investigation to find the confinee.

If the confinee returns to the monitored site and the counter output in the transmitted message is not the expected count or output, the monitoring unit provides an indication and time of a tamper to the supervisory personnel who report the event to the responsible officer. The officer can then determine whether the tamper has occurred away from the monitored site. If the strap was closed while the transmitter was out of range, the monitoring unit also transmits an approximate time of strap closure. This is possible since t' is shorter than T and the counter has not had sufficient time to count down from the initial count, to which it was reset at the tamper, to the expected counter output within the monitoring unit. The monitoring unit calculates the time of the tamper by determining the approximate elapsed time from the tamper and subtracting the elapsed time from the current time.

In a preferred embodiment, the strap is electrically conductive and a current through the strap is continuously monitored by the tamper indicating circuit. When the strap is opened the electrical continuity of the strap is interrupted and the tamper-indicating circuit no longer senses the current and causes the counter to reset its output to the initial count. Upon closing of the strap which establishes and restores the electrical continuity through the conductive strap, the tamper-indicating circuit enables the counter to count the clock pulses.

In an alternative embodiment of the present invention, the status of the strap is monitored by a tamper-indicating circuit which latches the status of the strap to enable a counter which incrementally counts clock pulses having a period of t. The counter output indicates the number of clock pulses counted while the strap has remained opened. The counter in this embodiment is not reset but merely rolls over once it has counted to the maximum value possible in the counter. After the strap is closed, the next clock pulse resets the latched count enable signal and the clock pulses are no longer provided to the counter. Such an embodiment could decrementally count the clock pulses to a minimum value as well.

When the monitoring unit of the alternative embodiment receives the first transmission from the transmitter, it stores the transmitted counter value and compares subsequent counter values received in messages from the transmitter. When the received counter value does not correspond to the stored counter value, the monitoring unit sends an alarm to the central monitoring station that a tamper has occurred and stores the last transmitted counter value in its memory. Subsequent counter values received are compared to this updated counter value.

The alternative embodiment can detect tampers immediately following installation as well as off site tampers, although there is a small probability that an off site tamper may stop the counter output after the counter has rolled over and returns to the last transmitted counter output. Since the transmitted counter value upon return to the monitored site in such a case would be the same as the last one transmitted before leaving, even though the counter had rolled over in the interim, the monitoring unit would not detect any tamper.

Another advantage of the present invention is the ability to initially set the transmission range of the transmitter to conform to the confinee's home or apartment and detect subsequent unauthorized changes to that transmission range. This advantage is provided by a small switch located within the housing of the transmitter which is inaccessible to the confinee without breaking the strap once the transmitter is strapped onto the confinee. Should the confinee attempt to gain access to the switch, the strap breaks and a counter output is transmitted that indicates a tamper has occurred. The transmission range switch connects one of a plurality of electrical loads to the antenna through which the identification code and counter output are radiated. These electrical loads are mismatched to the impedance of the antenna to reduce the transmission range of radiation from the antenna.

Yet another advantage of the present invention is implementation of a transmission range selection capability with a relatively few number of electrical components. Heretofore, transmission range has been selectively reduced from a maximum distance by regulating the input power or by attenuating the output through balanced loads. These methods were used to conserve input and output power losses, respectively. The electrical loads of the present invention used to reduce the transmission range of the transmitter are mismatched with respect to the antenna load and require fewer electrical components than balanced attenuation circuits on the output power control. This helps reduce the physical dimensions of the housing and the cost of construction since fewer parts are needed.

These and other objectives and advantages of the present invention are readily apparent from the following description of the drawings and the detailed description of the invention below.

DETAILED DESCRIPTION OF THE INVENTION

Figure 1:
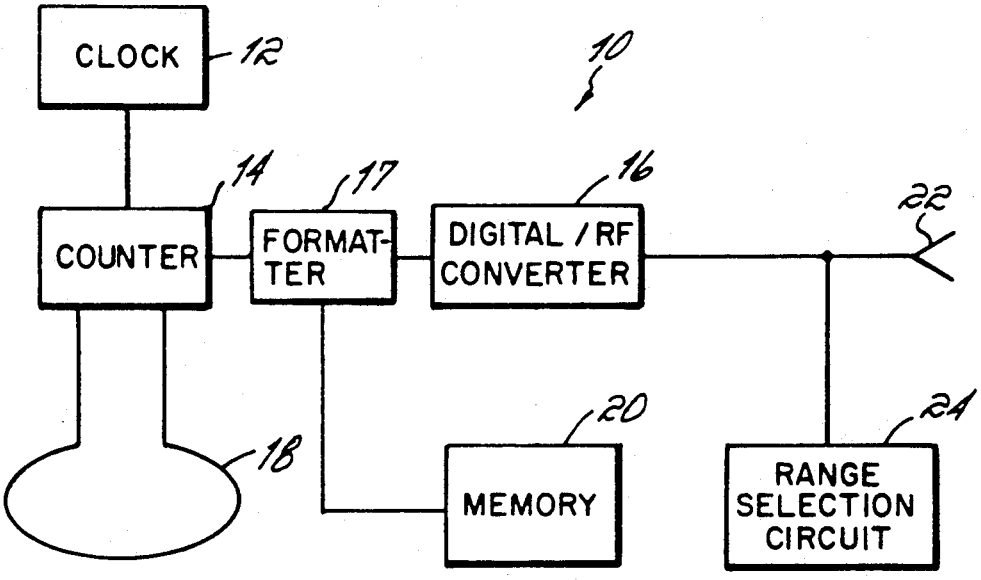
FIG. 1 is an electrical circuit in block diagram format of the tamper-indicating transmitter of the present invention.

Referring to FIG. 1, a tamper-indicating transmitter 10 is illustrated which incorporates the present invention. The transmitter 10 includes a clock 12 which provides a timing signal of clock pulses having a period t to a counter 14 that provides an output count of the clock pulses to a data formatter 17. Counter 14 is operatively connected to a strap 18 which is attached to the transmitter housing (not shown) to provide counter 14 an indication of whether strap 18 is closed about the confinee's limb. A memory 20 stores an identification code which is periodically provided to formatter 17. The digital output of counter 14 and the identification code from memory 20 are converted into a data word by formatter 17 which serially shifts the bits of the data word to digital/RF converter 16 which produces an RF frequency signal that is radiated through antenna 22. Range selection circuit 24 selectively connects one of a plurality of mismatched loads to the RF output of converter 16 which reduces the effective transmission range of transmitter 10. When range selection circuit 24 connects no load to the output of converter 16, the transmission range of transmitter 10 is at its greatest distance.

Figure 2:
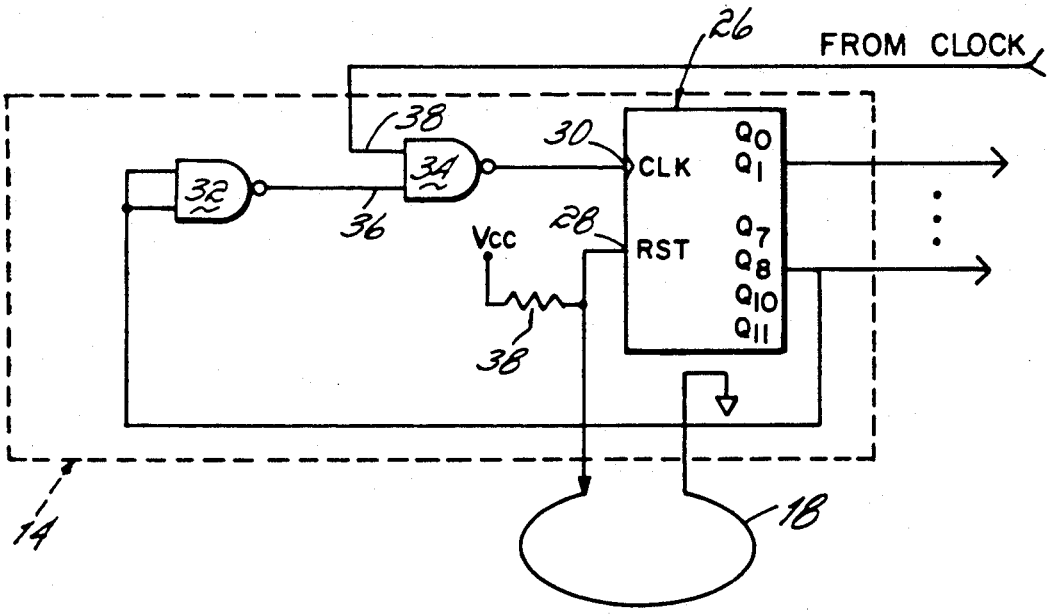
FIG. 2 is a schematic electrical circuit diagram of the counter in a preferred embodiment of the invention.

Counter 14 in a preferred embodiment of the present invention is shown in FIG. 2. Strap 18, in the preferred embodiment, is an electrically conductive strap through which the transmitter power supply, $V_{cc}$, and resistor 38 are connected to earth ground. The current supplied by $V_{cc}$ through strap 18 is monitored by tamper indicator 26 on its reset input 28, denoted as RST in the figure. Clock 12 provides a timing signal to counter 14 which outputs a count of the clock pulses of the timing signal on the parallel outputs, $Q_0$–$Q_{11}$, of tamper indicator 26 in accordance with the electrical continuity status of strap 18 provided on the reset input 28. While strap 18 is electrically conductive in the preferred embodiment, other embodiments are possible such as monitoring a fiber optic link, electro-magnetic circuit, heat sensor or the like, to provide an indication that strap 18 has been interrupted or opened. In the preferred embodiment of the present invention, clock 12 produces a timing signal having a period of 512 seconds, though the practice of the present invention is not necessarily limited thereto.

Control of the clock pulses input to the clock input 30, denoted CLK in FIG. 2, of tamper indicator 26 is provided by NAND gates 32, 34 and the $Q_8$ output of tamper indicator 26. $Q_8$ is tied to both inputs of NAND gate 32 to provide a clock enable signal to input 36 of NAND gate 34. Specifically, when $Q_8$ is a logic low NAND gate 32 outputs a logic high so the output of NAND gate 34 inverts the signal on its input 38 which is the timing signal from clock 12. When $Q_8$ is a logic high, the output of NAND gate 32 is a logic low and the output of NAND gate 34 provided to the CLK input of tamper indicator 26 remains a logic high and the counting of the inverted timing signal is suspended. When counting is suspended, the counter output remains at the last count value.

With further reference to FIG. 2, the electrical continuity status of conductor strap 18 in the preferred embodiment is shown on RST input 28 of tamper indicator 26. In the preferred embodiment, tamper indicator 26 is a CMOS 4040 12 bit binary counter and such devices are well known within the art. The supply voltage, $V_{cc}$, is effectively connected to ground through resistor 38 and conductive strap 18 with RST input 28 tied to the low potential side of resistor 38. Thus, as long as conductive strap 18 remains closed and connected to ground, the RST input remains a logic low and tamper indicator 26 counts the timing signal on the CLK input until $Q_8$ goes high causing NAND gate 34 to hold its output high which terminates timing signal input to CLK, as explained above. When conductive strap 18 is opened, either at installation or at a tamper event, the supply voltage, $V_{cc}$, and resistor 38 are no longer connected to ground through strap 18 and the RST input goes high which drives the counter output of tamper indicator 26 to a logic low condition. When the RST input is a logic high, tamper indicator 26 ignores any timing signal on its CLK input and the counter outputs of indicator 26 remain low. Upon the closing of conductive strap 18, the RST input goes low and tamper indicator 26 begins incrementing its output count in accordance with the timing signal on its CLK input up to the count value that drives the $Q_8$ output high. Thus, the counter output of tamper indicator 26 provides an elapsed clock pulse count from the last strap closure.

Referring again to FIG. 1, the output of counter 14 is provided to formatter 17. Formatter 17 receives the parallel output of counter 14 and the parallel output of memory 20 which contains the identification code. This parallel data word is converted to a serial data stream that is supplied to digital/RF converter 16 for transmission to the monitoring unit. In the preferred embodiment of the invention, the $Q_1$–$Q_7$ output of counter 14 is logically inverted so the monitoring unit receives a counter output which decrements rather than the incrementing count on outputs $Q_1$–$Q_7$, though the incrementing count could be used. The logic for inverting the counter output and the parallel to serial conversion logic within formatter 17 are well known within the art. While the output provided from counter 14 to formatter 17 consists of bits $Q_1$–$Q_7$ in the preferred embodiment, other bits could be used to provide the tamper-indication in the message transmitted to the monitoring unit. Converter 16 in the preferred embodiment is a MX1001 type manufactured by RF Monolithics, Inc. of Dallas, Tex. The carrier frequency produced by the converter of the preferred embodiment is 318 MHz. This carrier frequency is pulsed when the serial data input bit is a logical one to produce an amplitude modulated signal which is radiated through antenna 22. Other digital/radio frequency converters could be used and other output frequencies and data transmission schemes used.

Figure 3:
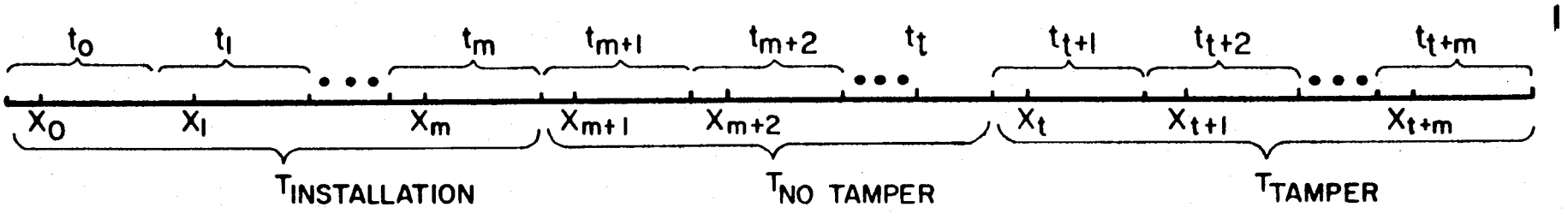
FIG. 3 is a time line depicting the relationship of the period t of the timing signal produced by the clock, some of the transmissions of the transmitter and tamper alert periods for an operational period of the transmitter.

The timing relationships between the timing signal period t, the times of one transmitted message containing the identification code and counter output from converter 16 during each period t, and a tamper alert period T following a tamper or installation event, are shown in FIG. 3. The length of the time line in FIG. 3 represents an operational period for transmitter 10 and includes a time period, $T_{INSTALLATION}$ that follows installation of the transmitter about the confinee, a time period of no interruption in the conductive loop, $T_{NO\ TAMPER}$, that follows the installation period and a tamper period, $T_{TAMPER}$, that follows the period without interruption in the conductive strap.

The time intervals marked $t_0$, $t_1$, etc. are time intervals representing one period of the $Q_0$ output from tamper indicator 26. Each of the events marked $x_0$, $x_1$, etc. indicates a transmission of the identification code and counter output by converter 16. Although multiple transmissions of the counter output and identification code are made during each time interval t in the preferred embodiment of the invention, one transmission during each period t is sufficient to provide the counter output to the monitoring unit, if received. The multiple transmissions of the preferred embodiment ensure message reception by the monitoring unit and permit data integrity checks of the transmitted messages in the monitoring unit.

At the installation of the transmitter at the monitored site, an officer secures strap 18 about a limb, usually the leg, of the confinee. Prior to securing the transmitter to the confinee, the battery is placed in the transmitter to activate it and a plate is secured over the battery making it inaccessible once strapped to the confinee to prevent the confinee from later removing the battery and turning the transmitter off.

To place the strap about the limb or other body part on the confinee, the officer must open strap 18 which provides a logic high signal to the RST input of tamper indicator 26, driving its output low as previously explained. In the preferred embodiment, a data transmission, $x_0$, during the first time period t following the opening of strap 18 includes the identification code from memory 20 and an all logical high counter output produced by formatter 17 from the $Q_1$-$Q_8$ outputs from tamper indicator 26. The monitoring unit always compares the identification code in a transmitted message with a reference identification code stored in the monitoring unit to see if they are equivalent. If the transmitted identification code is not equivalent to the reference identification code, the monitoring unit does not process the contents of the transmitted message. When the transmitted identification code is equivalent to the reference identification code, the monitoring unit examines the transmitted counter output to determine whether a tamper event has occurred. Upon receipt of the transmitted counter output, the monitoring unit initializes a counter to the transmitted counter output and begins counting down clock pulses of period t. Subsequent transmitted counter outputs are compared to the countdown value of the monitoring unit counter to determine a tamper, as explained below.

Should conductive strap 18 remain open, the subsequent data transmissions continue to show an all logical high count from formatter 17 that was produced from the $Q_1$-$Q_8$ outputs from tamper indicator 26. The monitoring unit compares the transmitted counter output to the countdown value in the monitoring unit and sends a tamper alarm to the central monitoring station if the transmitted counter value is greater than the countdown value. Upon the closing of the conductive band about the confinee's limb, the RST input line to tamper indicator 26 goes low to permit tamper indicator 26 to count the timing signal on its CLK input. Using the first decremented counter value received in the transmitted message of the preferred embodiment, the monitoring unit computes the time of the strap closure and sends it to the central monitoring station. The supervisory personnel report the time of the alarm to the officer who usually ignores the alarm when it coincides with the time of installation.

A transmission during each of the subsequent time periods of t are represented by $x_1$-$x_m$. These transmissions provide the decrementing counter output produced from tamper indicator 26 outputs $Q_1$-$Q_7$ for each period t until $Q_1$-$Q_7$ are zero and $Q_8$ becomes a logic high. As previously discussed, the $Q_8$ output going high blocks the input of the clock signal to the CLK input of tamper indicator 26 through NAND gate 34. Thus, the counter output of tamper indicator 26 on outputs $Q_1$-$Q_8$ represented by the binary number 10000000 is the maximum count output, M, by tamper indicator 26. In the preferred embodiment of the invention, $Q_8$ is a control signal to formatter 17 that causes formatter 17 to provide a 7 bit all logical low word to converter 16 as long as $Q_8$ is high. Other counting schemes could be used without departing from the principles of the present invention.

The time required for tamper indicator 26 to count from an all logic high output at a strap closure to an all logic low output defines a tamper alert period. In FIG. 3, two such periods are shown, $T_{INSTALLATION}$ and $T_{TAMPER}$. The length of the tamper alert period is determined by the number of possible counter outputs and some inherent timing inaccuracies associated with the counting of the clock pulses. In the preferred embodiment of the invention, the formula for computing the length of the tamper alert period is: $(126 \times 1024$ sec$) + 768$ sec$\pm 256$ sec. This provides a tamper alert period of 35.98 hours or 36.12 hours following a strap closure. The value 126 represents the highest number of valid count values possible, since of the 128 possible states, two states, the all logical low and all logical high, may be transmitted for consecutive time periods of t to indicate an open strap condition and a tamper alert period expiration, respectively. The 1024 second multiplier is the base time period of the count presented on outputs $Q_1$-$Q_7$. Since the $Q_1$ output does not change until 8.5 minutes to 17 minutes after a strap closure, the 768 seconds are added to the parenthetical value in the formula to move the earliest possible closure time and the latest possible closure time within 256 seconds of the actual time. By subtracting and adding the 256 second difference to the time estimate, a range is estimated within which the strap closure must have occurred. While the length of the tamper alert period in the preferred embodiment effectively ensures that it is longer than an excused absence period, other adjustments could be made to the tamper alert period which conform to the principles of the present invention.

During the tamper period following installation, $T_{INSTALLATION}$, the officer receiving the report from the central monitoring station usually ignores the report of the strap closure that approximately coincides with the transmitter installation. However, any change in the last strap closure time provided by the monitoring unit to the central monitoring station indicates that another opening of strap 18 within tamper alert period T has occurred. If strap 18 remains open, subsequent transmitted messages contain a counter output of all ones in the preferred embodiment. If strap 18 is closed thereafter, the transmitted messages during each period t contain an accumulated counter output which the monitoring unit compares to the countdown value within the monitoring unit. If the accumulated counter output in the transmitted message is greater than the countdown value, the monitoring unit generates a new time of last strap closure which enables the officer to distinguish between the strap closure which commences with $T_{INSTALLATION}$ and any subsequent tamper.

If no tamper event occurs during $T_{INSTALLATION}$ of FIG. 3 then each data transmission in the preferred embodiment following the conclusion of $T_{INSTALLATION}$ contains the minimum counter output of all zeros. These transmissions, denoted $x_{m+1}$, etc., continue until a tamper event is caused by the opening of conductive loop 18. If conductive strap 18 is reconnected, tamper indicator 26 begins counting the timing signal from clock 12 for the time period denoted $T_{TAMPER}$. During this time, the transmitted messages from converter 16 contain an accumulated count for each period t which indicates a tamper has occurred since the countdown value in the monitoring unit also decremented to all zeros. The length of $T_{TAMPER}$ is the same as $T_{INSTALLATION}$ since the number of clock pulses counted and the time period of the clock pulses are the same.

Figure 4:
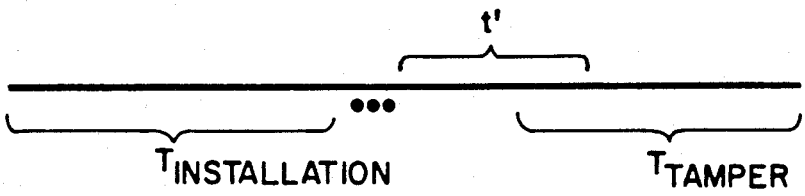
FIG. 4 is a time line representation of the detection of a tamper occurring during an excused absence of period t'.

As shown in FIG. 4, the counting output of tamper indicator 26 of the present invention provides an indication of tamper events which occur away from the monitor site and the ability to pinpoint the time of the tamper event if the strap is reconnected. The time period denoted t' is a period of excused absence in which the confinee is allowed to leave the monitored site. Usually such a time period is for the purpose of allowing the confinee to go to work. At the commencement of this period t', the monitoring unit transmits an alarm indicating the transmitted message from transmitter 10 is no longer being received. The central monitoring station verifies that the absence of transmissions corresponds with an excused absence period.

If the confinee returns to the monitored area with transmitter 10, the monitoring unit sends a message to the central monitoring unit that messages from transmitter 10 are being received. Should a tamper take place during time interval t' and the confinee returns to the monitored site with the transmitter 10, the monitoring unit begins to receive messages transmitted from converter 16 containing the counter output from which the monitoring unit can determine whether a tamper has occurred and the estimated time of the tamper. As long as time period $T_{TAMPER}$ is greater than any reasonably foreseeable excused time period t', the messages received by the monitoring unit when transmitter 10 is returned within the monitored area contain an accumulated counter output for each period t. The monitoring unit computes an elapsed time from the tamper event by using the counter output in the first message received from transmitter 10 when the confinee returned. The monitoring unit then subtracts the elapsed time from the current time to arrive at the approximate time of the tamper event. This information is then sent to the central monitoring station and is reported to the officer responsible for the confinee. Such information can assist the officer in judging the credibility of the confinee's reasons for the tamper event, such as an accident in the work place or in traveling.

Figure 5:
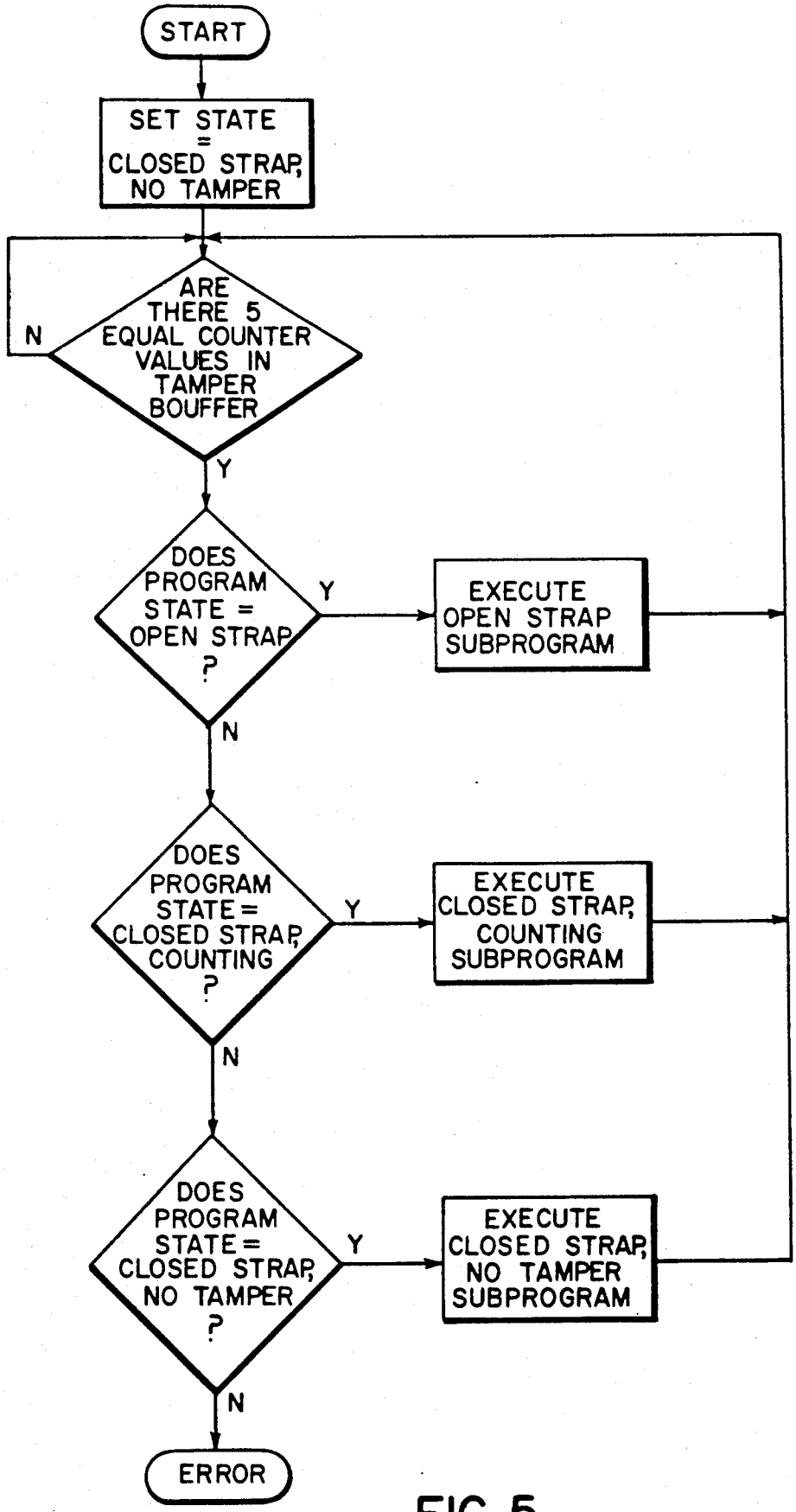
FIG. 5 is a flowchart of the program in the monitoring unit.

The flowcharts of FIGS. 6 through 9 depict the logic of the program within the monitoring unit. Upon initialization or resetting of the monitoring unit, FIG. 5 shows the program state is set to "closed strap, no tamper" and the program waits for the reception of a transmitted message from transmitter 10. The receiving circuitry of the monitoring unit, in terms of the manner in which it extracts data from the transmitted signal, essentially operates as the receiving circuitry of the monitoring unit described at pages 25–29 of my U.S. application Ser. No. 07/343,814 previously incorporated by reference in its entirety. The bytes of the transmitted message which correspond to the identification code and the counter output are stored in a received data buffer along with the timestamp indicating the time each byte was received. The bytes representing the counter output and their associated timestamps are stored in a tamper buffer for analysis. In the preferred embodiment, when at least five bytes and their associated timestamps having the same counter output have been placed in the tamper buffer, the program determines the status of the confinee. As shown in FIG. 5, this is done by the program executing the logic for the current state of the program.

Figure 6:
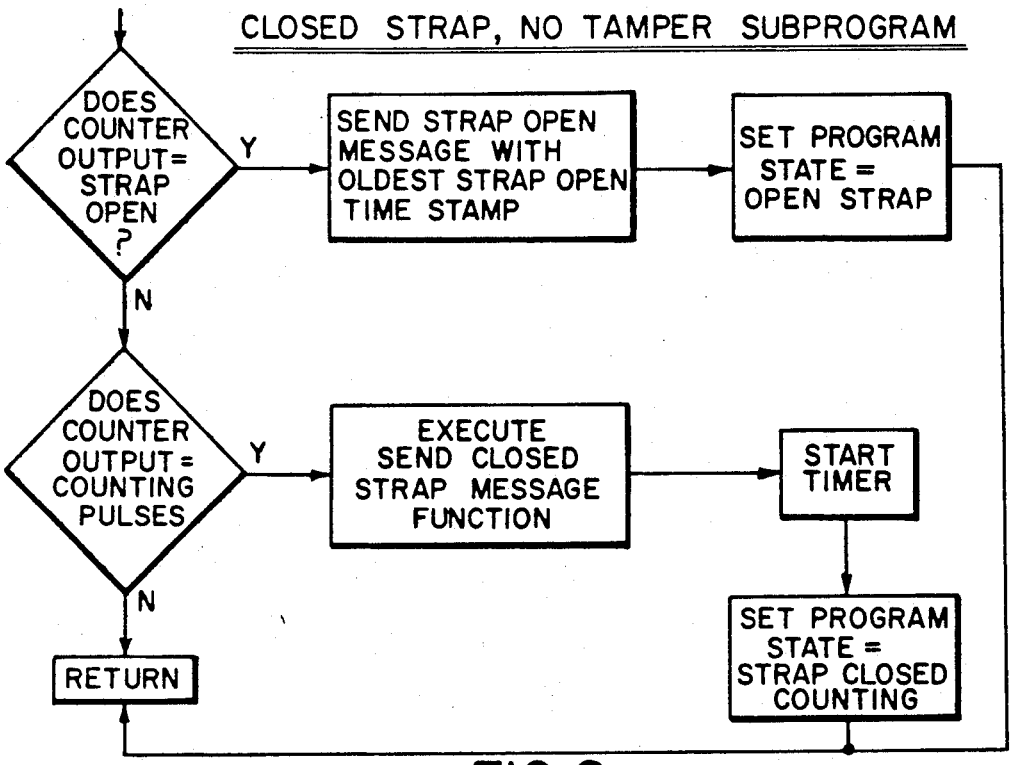
FIG. 6 is a flowchart of the Closed Strap, No Tamper subprogram in the monitoring unit.

When the program is in the closed strap, no tamper state, the program executes the closed strap, no tamper subprogram depicted in the flowchart of FIG. 6. In the preferred embodiment, if the five most recent entries have a counter output that indicates the strap is open, the tamper buffer is searched to find the timestamp of the first counter output indicative of an open strap. A message indicating the strap is open is sent to the central monitoring station. The message contains the timestamp of the first counter output indicating the open strap condition. The program state is then changed to open strap. If the counter output of the last five bytes in the tamper buffer indicate tamper indicator 26 is counting clock pulses, then the program executes the logic for informing the central monitoring station that the strap is closed and the starting time of the tamper alert period. After executing this logic, a timer is initiated to time the period following this strap closure and the program state is altered to closed strap, counting.

Figure 7:
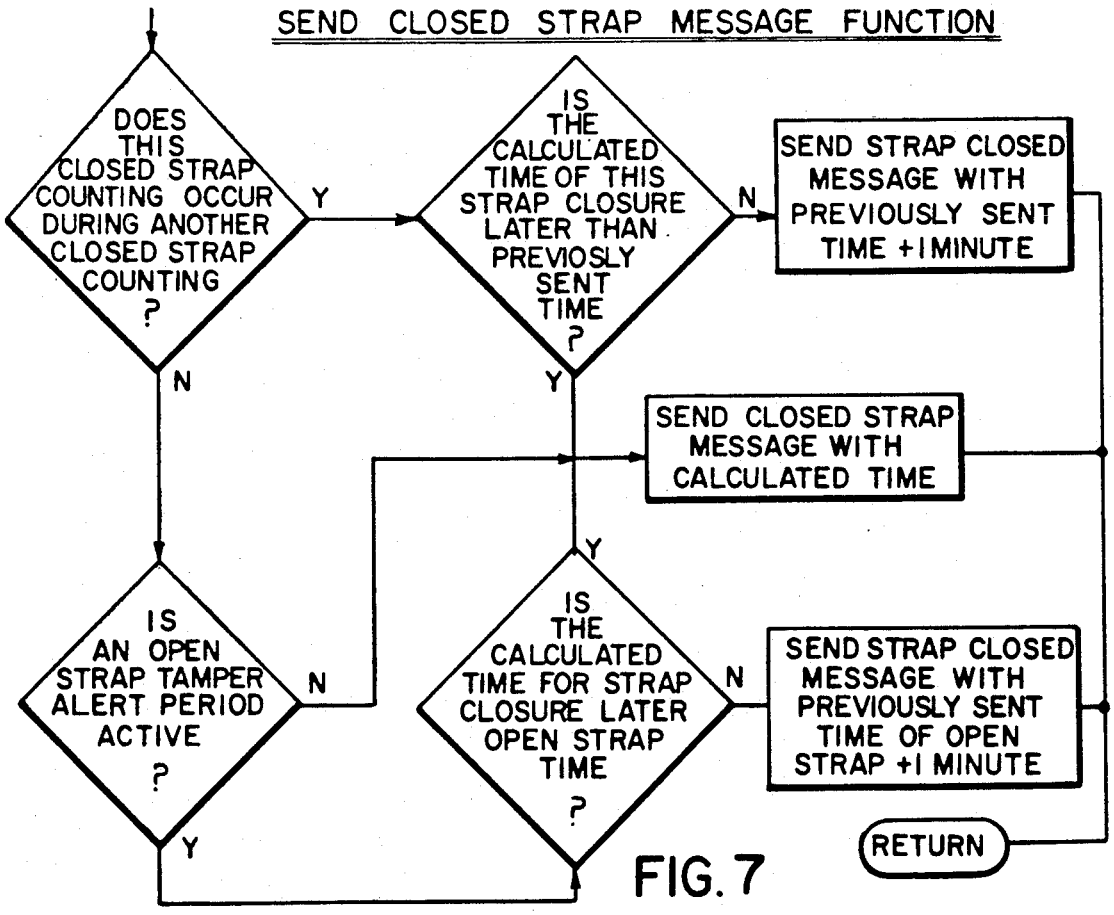
FIG. 7 is a flowchart of the Send Closed Strap Message function in the monitoring unit.

The logic for determining the starting time of a strap closure and sending a closed strap message to the central monitoring station is shown in FIG. 7. The logic first determines if the counter output that indicates strap closure occurred during a counting sequence resulting from a prior strap closure. If it did, then the calculated strap closure time for the new strap closure is compared to the calculated strap closure time sent to the central monitoring station for the strap closure that resulted in the interrupted counting sequence. If the calculated time for the new strap closure is earlier than the previously sent calculated time, timing synchronization between the monitoring unit and transmitter has been lost and the new strap closure status to be sent to the central monitoring station is given a calculated timestamp of the previously sent strap closure time plus one minute. This loss of timing synchronization occurs when the central monitoring station adjusts the timing in the monitoring unit and no corresponding adjustment is made in the transmitter clock. This ensures that the central monitoring station recognizes the new strap closure message as occurring after the previously sent strap closure message.

If the new strap closure happened within the tamper alert period following a previously detected open strap count then the calculated time for the new strap closure is compared to the calculated time for the open strap status previously sent to the central monitoring station. Since the time of the open strap status sent to the central monitoring station corresponds to the timestamp associated with the first counter output byte received and the time of the closed strap status is calculated with the offsets as previously discussed, the time of strap closure may precede that of the open strap status. If this happens, the open strap time is incremented by one minute so the central monitoring station can determine that the closed strap status temporally follows the open strap status. If the previously sent time for the prior open strap message is earlier than the calculated time for the new strap closure or if no open strap condition is currently active, i.e., within a currently active tamper alert period, then the calculated time is included in a close strap message to the central monitoring station.

Figure 8:
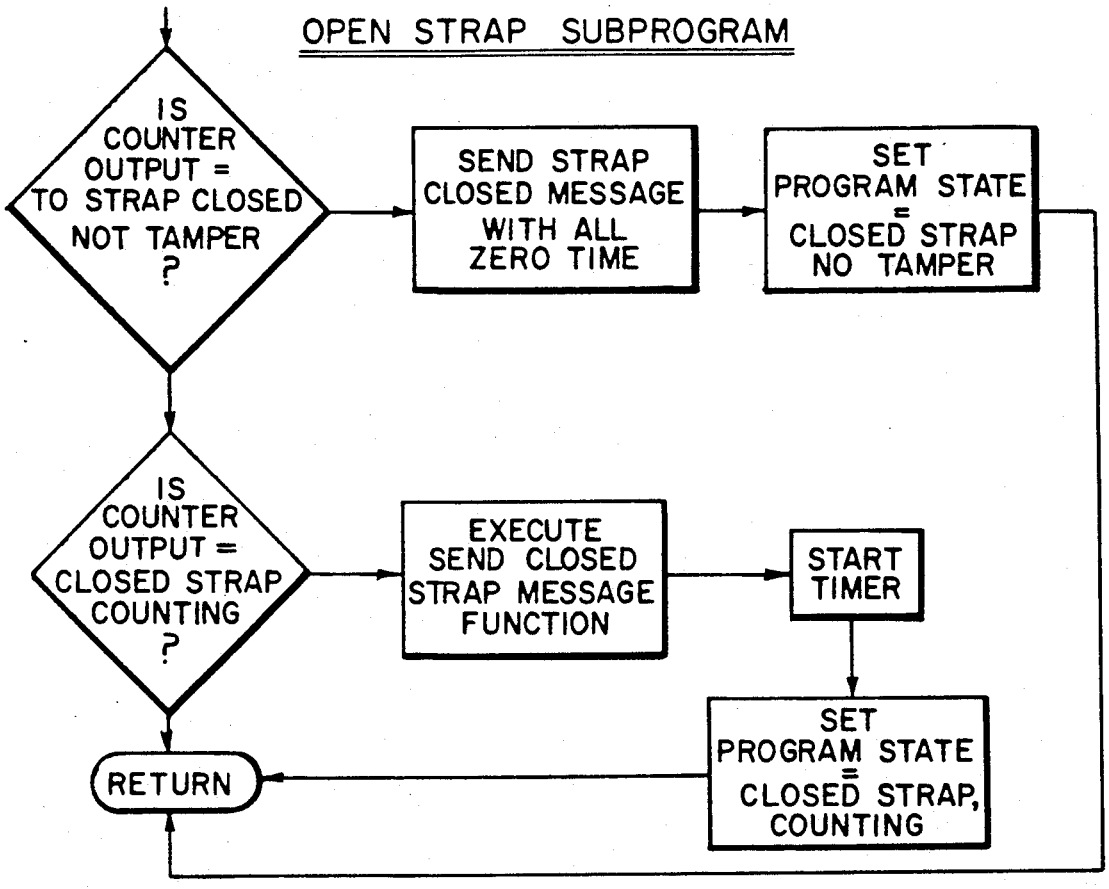
FIG. 8 is a flowchart of the Open Strap subprogram in the monitoring unit.

If the program of FIG. 6 is in the open strap state then the logic of the flowchart in FIG. 8 is performed. In this state if a counter output indicative of a closed strap following expiration of a tamper period is detected, then a timestamp of all zeros is sent in a closed strap message to the central monitoring station to indicate a strap closure and tamper alert period expiration took place without detection by the monitoring unit. The program state is then changed to closed strap, no tamper. If a counter output indicative of the counting of clock pulses following a closed strap condition is the latest byte in the tamper buffer, then the logic shown in FIG. 7 is executed to provide a closed strap message with a timestamp to the central monitoring station. Afterwards, a timer is initiated to count the period following the closed strap condition and the program state is changed to closed strap, counting clock pulses.

Figure 9:
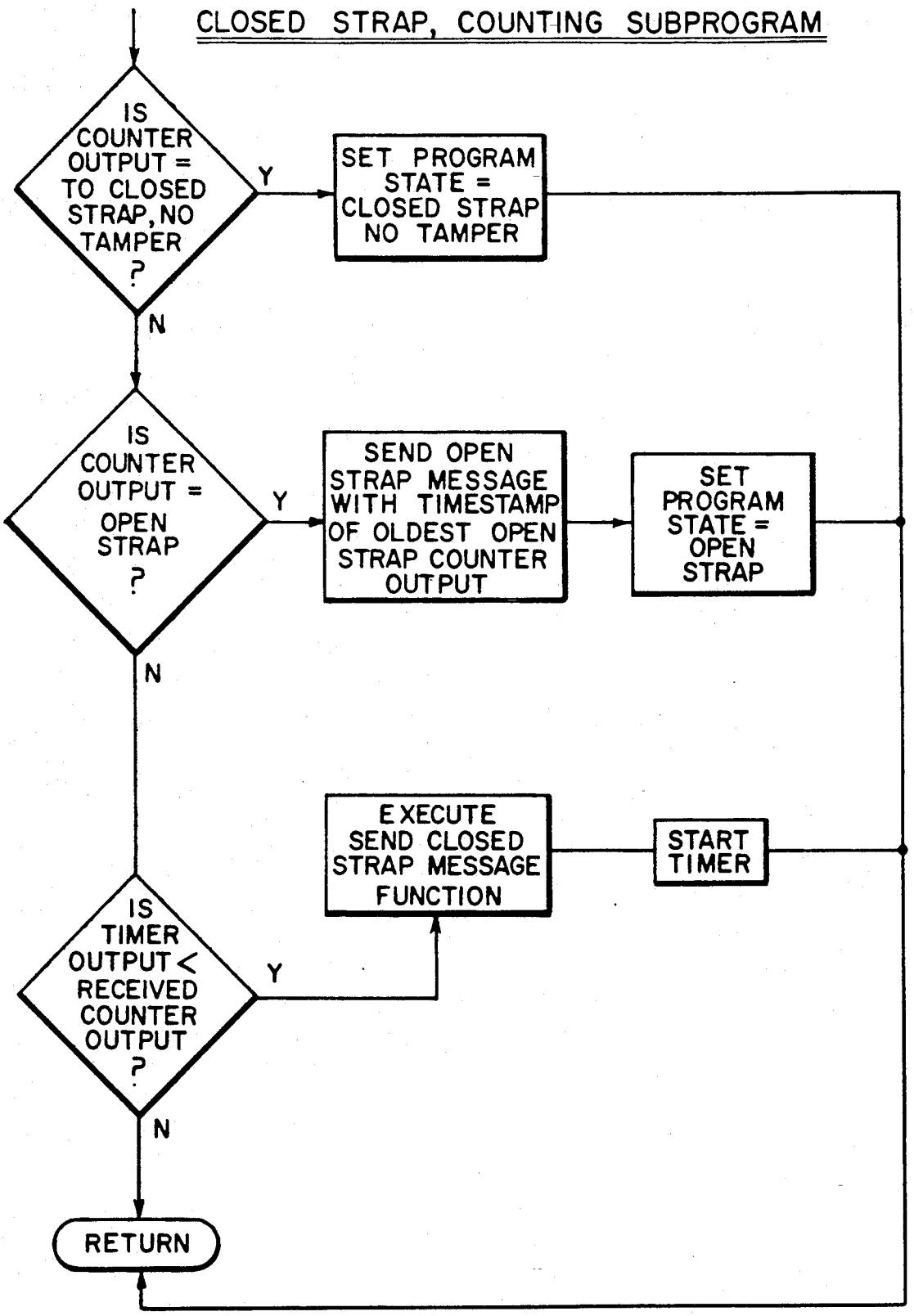
FIG. 9 is a flowchart of the Closed Strap, Counting subprogram in the monitoring unit.

The flowchart of FIG. 9 shows the logic of the program in the strap closed, counting clock pulses state. If the counter output in the received data buffer indicates tamper indicator 26 has counted the number of pulses that define the tamper alert period, then the program state is changed to the closed strap, no tamper state. If the counter output in the received data buffer indicates an open strap, a message is sent to the central monitoring station that indicates the strap is opened with the timestamp of the first byte which indicates the current open strap condition. The program state is then modified to the open strap state.

The remainder of the flowchart in FIG. 9 relates to a counter output that indicates tamper indicator 26 is counting clock pulses following a strap closure. If the timer output is less than the received counter output, in the preferred embodiment, then the logic corresponding to the flowchart in FIG. 7 is executed and the timer is initiated.

Figure 10:
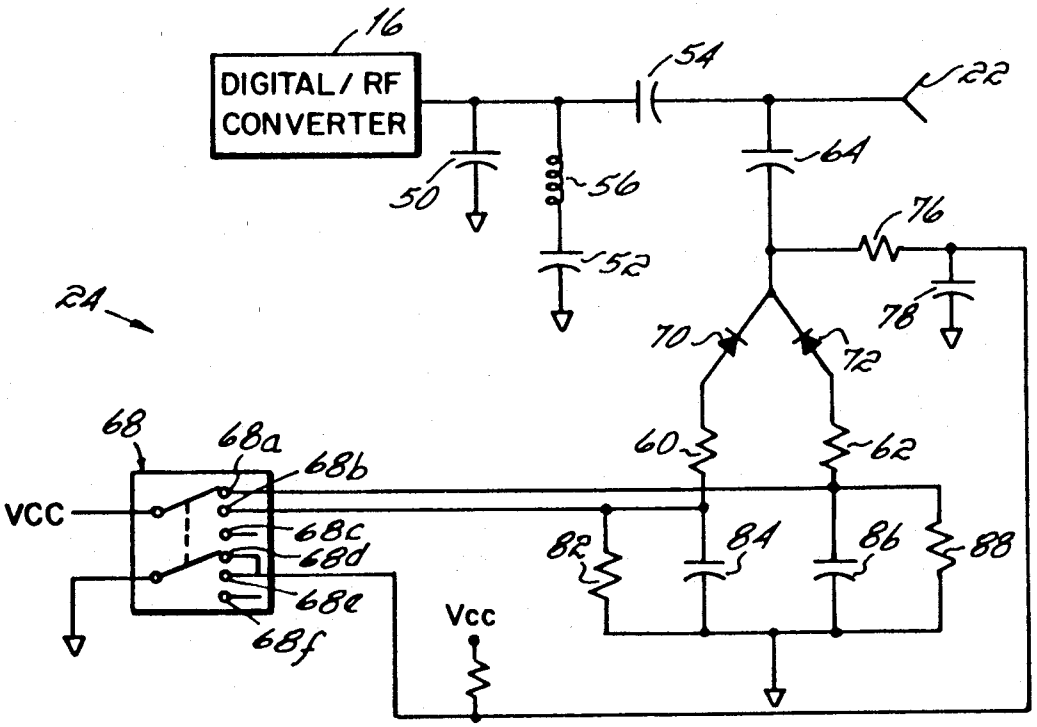
FIG. 10 is a schematic representation of the transmission range selection circuit.

To simplify manufacturing, transmitters constructed according to the present invention can be manufactured with the same power source and RF converter 16 regardless of the final transmission range needed to monitor the confinee. To vary the output power of converter 16 so the transmitter can be used on any confinee regardless of the size of the monitored area in which they are confined, range selection circuit 24 is provided in the preferred embodiment of the invention as shown in FIG. 1. A schematic diagram of range selection circuit 24 is shown in FIG. 10. The radio frequency output of converter 16 is conditioned by capacitors 50, 52 and inductor 56 to suppress the harmonics of the output frequency as is well known within the art.

The remaining components are used to selectively couple resistive loads $R_{60}$, $R_{62}$ through capacitor 64 to the output of converter 16 at capacitor 54. Resistors $R_{60}$, $R_{62}$ are selected to provide output loads which are mismatched with the output load of antenna 22. Specifically, the position of switch 68 determines which load is coupled to the output of converter 16 to reduce the transmission range of transmitter 10 through antenna 22.

When switch 68 connects the transmitter power supply, $V_{cc}$, to position 68-*a* and earth ground to position 68-*d*, as shown in FIG. 10, current from $V_{cc}$ is provided through resistor 62, diode 72, and resistor 76 to unbalance the output load on converter 16 and reduce the transmission range of transmitter 10. When diode 72 is forwarded biased by current from $V_{cc}$, diode 70 is reversed biased since its cathode end is dc connected to ground through resistor 76 and switch 68 while the anode end is dc connected to ground through resistor 82. RF components in load resistor 62 are grounded through capacitor 86. If switch 68 is moved so positions 68-*b* and 68-*e* are connected to $V_{cc}$ and ground, respectively, current from $V_{cc}$ forward biases diode 70 to load the output of converter 16 with resistor 60. In this switch position, capacitor 84 grounds RF components on load resistor 60 and resistor 88 grounds diode 72 at its anode end while resistor 76 grounds diode 72 at its cathode end. When switch 68 is moved to positions 68-*c* and 68-*f* neither load resistor 60, 62 is coupled to the output of converter 16 since $V_{cc}$ is no longer grounded through switch 68 causing both diodes 70, 72 to be reverse biased. Converter 16 no longer drives a mismatched load and the range of transmitter 10 is at its maximum distance. Capacitor 78 is provided to remove any ac components on the path to ground from the cathode of the reversed biased diode in the circuit.

The circuit of FIG. 10 has the advantage of requiring fewer parts than attenuators which provide balanced loads to a transmitter's output. Such attenuators are generally known in the art and typically include three load resistors in a pi configuration for each load used to reduce the output power. Not only does each attenuator require more resistors for each selected load but the circuitry to selectively connect each attenuator to the converter output would require more diodes, capacitors and resistors than those needed to selectively switch the load resistors 60, 62 to the converter output.

While converter 16 used in the preferred embodiment of the invention provides a control voltage for changing its output power, we have found the regulation of the output power in this manner to be unreliable. The range selection circuit constructed according to the principles of the present invention provides a reliable structure for selectively varying the output range. Specifically, our range selection circuit provides an electrically cleaner output signal and a shorter turn-on time than those associated with the converter in the preferred embodiment when the control voltage input is used to regulate output power. Both of these characteristics are desirable in the use of the present invention. By sizing resistor 60 to be significantly larger than resistor 62, the transmission power can be reduced from a no load condition to a slightly loaded condition when resistor 60 is placed on the output and further loaded to significantly reduce the output power when switch 68 places resistor 62 rather than resistor 60 on the output. When switch 68 is placed within the transmitter housing which is held against the confinee's limb or located underneath conductive strap 18, the confinee cannot change the position of switch 68 without opening conductive band 18 and causing transmitter 10 to transmit a counter output indicative of a tamper.

Figure 11:
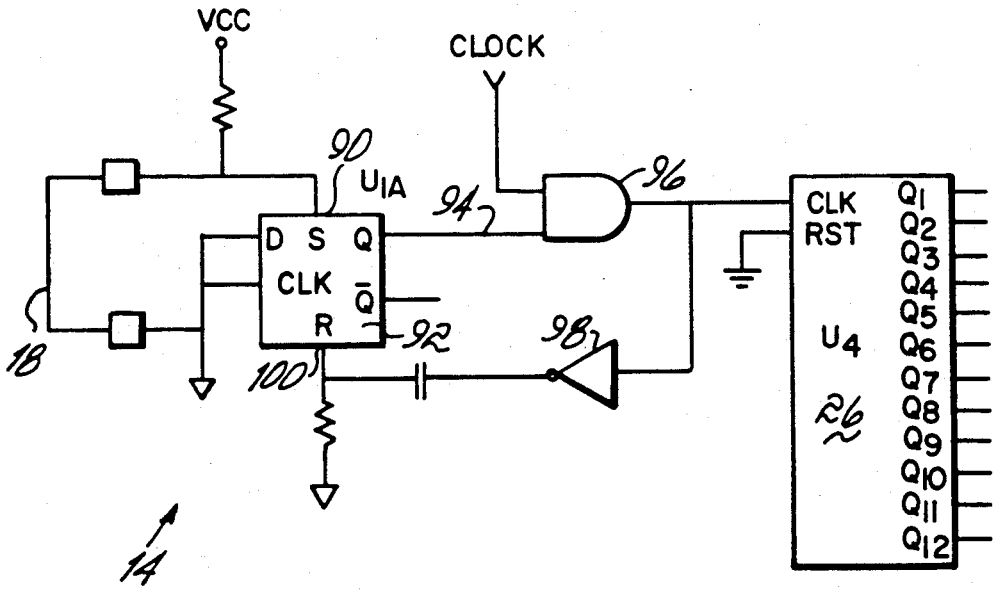
FIG. 11 is a schematic electrical circuit diagram of the counter in an alternative embodiment of the invention.

An alternative embodiment of a counter constructed according to the principles of the present invention is shown in FIG. 11. Using the numbers from previous figures to denote like parts in this figure, the counter 14 receives the clock signal output by clock 12 and outputs the counter lines $Q_1$-$Q_{12}$ to formatter 17. A strap 18 is shown connecting $V_{cc}$ to earth ground and the status of the strap is monitored at the set input 90 of a D flip-flop 92, such flip-flops being well known within the art. The D and clock (CLK) inputs of flip-flop 92 are connected to ground. When strap 18 is closed, input 90 is a logic low and Q output 94 is a logic low which holds the output of AND gate 96 to a logic low. The output of AND gate 96 is input to the clock input of tamper indicator 26 which has its reset input (RST) grounded. As long as the Q output of flip-flop 92 remains low, tamper indicator 26 cannot receive clock pulses on its CLK input and the output lines, $Q_1$-$Q_{12}$, of tamper indicator remain at their previous state. When strap 18 is opened, input 90 receives a logic high which drives the output of flip-flop 92 high. This permits the output of clock 12 to pass through AND gate 96 to the CLK input of tamper indicator 26. Tamper indicator 26 counts the clock pulses and increments the output on $Q_1$-$Q_{12}$. Thereafter when strap 18 is closed, the next falling edge of the clock through AND gate 96 is inverted by inverter 98 to provide a reset signal to reset input 100 on flip-flop 92 which drives the Q output low. This disables further clock signals from reaching tamper indicator 26 and its output on $Q_1$-$Q_{12}$ remains unchanged.

The monitoring unit of the alternative embodiment stores the first counter output it receives in a transmitted message from the transmitter as the expected counter output. Should strap 18 be opened, the Q output of flip-flop 92 goes high and at least one clock edge is counted by tamper indicator 26, even if strap 18 is immediately closed, before the reset signal from inverter 98 resets flip-flop 92 to disable further clock input to tamper indicator 26. When the monitoring unit receives the updated output count in a transmitted message from the transmitter and compares it to the expected counter output, it recognizes that at least one tamper has occurred and generates an alarm message to the central monitoring station.

While the above describes a preferred embodiment and an alternative embodiment constructed according to the principles of the present invention, it is to be understood that the invention is not limited thereby and that in light of the present disclosure of the invention, various other alternative embodiments would be apparent to those skilled in the art. For example, various lengths of time periods for the output of clock 12 could be used to achieve the objectives of the present invention. Additionally, other schemes of varying the output power of the radio frequency converter or of selecting variable loads for the output of the converter would be obvious to those in the art. Other counting schemes can also be envisioned in which the tamper indicator 26 counts tamper events rather than clock pulses.

In view of the above, various changes can be made without departing from the scope of the invention as particularly pointed out and distinctly claimed in the appended claims.

I claim:

1. A tamper-indicating transmitter which can be strapped about an individual's limb or other body part, comprising:

a strap to encircle the individual's limb and hold said transmitter in close proximity to said limb;

means for generating a strap status signal responsive to tampers to said strap, said strap status signal being indicative of whether said strap is secured about the individual's limb;

a clock for generating clock pulses, each of said clock pulses having a period t;

counting means for counting said clock pulses in response to said strap status signal, said counting means commencing counting of said clock pulses from a predetermined initial count to a predetermined final count, the absolute difference between said predetermined initial count and said predetermined final count multiplied by said period t defining a time period T, said counting means providing a counter output corresponding to the number of pulses counted by said counting means at least once each period t, said counter output being said predetermined initial count whenever said strap status signal indicates said strap is opened, said counter output being an accumulated count during time period T when said strap status signal indicates said strap is closed, and said counter output being said predetermined final count at the expiration of time period T when said counting means has counted to said predetermined final count without an intervening strap status signal indicative of an open strap;

memory means for storing an identification code; and transmitting means for transmitting data over a predetermined transmission range, said transmitted data including said identification code from said memory means and said counter output of said counting means, said transmitting means transmitting said data at least once within each said period t so that a monitoring unit receiving said transmitted data can determine that the individual to which said tamper-indicating transmitter is strapped is within a monitored area defined by a radius of said transmission range swept about said monitoring unit by comparing said transmitted identification code with a reference identification code equivalent to said identification code stored in said memory and detect said tamper occurring at the commencement of said time period T by initializing a timer within said monitoring unit to said counter value received in said transmitted message, said timer outputs an expected counter output to which said monitoring unit compares subsequent counter outputs in said transmitted messages whereby said monitoring unit detects a tamper when said counter output in said subsequent transmitted message is substantially different from said expected counter output, said monitoring unit calculating an elapsed time from said tamper by multiplying said counter output by said period t and subtracting said elapsed time from the current time.

2. The tamper-indicating transmitter of claim 1 wherein said period t has a predetermined length to permit continuous observation of said transmitter and the individual by an installing officer for a conveniently short time interval, said period t being extremely short relative to said period T so that said counting means counts from said predetermined initial count following an opening and closing of said strap during the strapping of said strap about the individual's limb so said monitoring unit receives at least one data transmission containing said counter output to verify said counting means is counting said clock pulses while the installing officer is observing said transmitter and the individual, whereby a subsequent data transmission that includes a counter output substantially different than said expected counter output within said time period T indicates a tamper with said strap not occurring as an incident to the installation of said tamper-indicating transmitter about the individual's limb.

3. The tamper-indicating transmitter of claim 1 wherein the length of said time period T is selected to have a predetermined length substantially greater than a time segment t' to permit the continued counting of said clock pulses for a period greater than said time segment t' so that at least one data transmission containing said counter output substantially different from said expected counter output is transmitted upon return of the individual to said monitored area at the expiration of time segment t' if a tamper occurred to said strap, said time segment t' corresponding to an excused time segment for the individual to be outside said monitored area.

4. The tamper-indicating transmitter of claim 1 further including:

means for selectively adjusting said transmission range of said transmitting means, said selectively adjustable transmission range means being inaccessible when said tamper-indicating transmitter is strapped about the individual's limb so that said monitored area in which the monitoring unit can detect the individual wearing said tamper-indicating transmitter can be predeterminately selected prior to installation of the transmitter on the individual's limb to conform to the structure in which the individual is housed, but cannot be readjusted by the individual once installed without said generating means generating a signal indicative of said strap not being secured about the individual's limb and thereby causing said monitoring unit to detect a tamper.

5. The apparatus of claim 4 wherein said transmitting means includes, an antenna, and wherein said range transmission adjustment means includes:

means for selectively connecting an electrical load to said antenna to electrically load said transmitting means, said electrical load being mismatched with said antenna to decrease the power of the transmission radiated through said antenna.

6. The tamper-indicating transmitter of claim 1 wherein said strap is conductive to provide a current path around the individual's limb when said transmitter is secured to the individual;

said generating means generates said strap status signal in response to the electrical continuity of said current path in said conductive strap being interrupted and restored.

7. A method for indicating a tamper to a transmitter strapped about an individual's limb or other body part, comprising:

encircling a strap about a limb or other body part of the individual to hold said transmitter in close proximity to said limb;

generating a strap status signal responsive to tampers to said strap, said strap status signal being indicative of whether said strap encircles the individual's limb;

generating clock pulses, each of said clock pulses having a period t;

counting said clock pulses in response to said strap status signal, said counting step commencing from a predetermined initial count to a predetermined final count, the absolute difference between the initial count and the final count multiplied by said period t defining a time period T;

establishing an output count corresponding to the number of clock pulses counted by said counting step at least once each period t in response to said strap status signal which indicates a tamper event, said established count being one of an accumulated count, said predetermined initial count and said predetermined final count, said established count being said predetermined initial count whenever said strap status signal indicates said strap is opened, said established count being said accumulated count whenever said strap status signal indicates said strap is closed during said period T, and said established count being said predetermined final count when said strap status signal indicates said strap is closed following expiration of said period T;

storing an identification code; and transmitting data through an antenna over a predetermined transmission range at least once each period t, said transmitted data including said stored identification code and said established output count, so that a monitoring unit receiving said transmitted data can determine that the individual to which said tamper-indicating transmitter is strapped is within a monitored area defined by a radius of said transmission range swept about said monitoring unit by comparing said transmitted identification code with a reference identification code equivalent to said identification code stored in said memory and detect said tamper occurring at the commencement of said time period T by initializing a timer within said monitoring unit to said established count received in said transmitted message, said timer outputs an expected counter output to which said monitoring unit compares subsequent counter outputs in said transmitted messages whereby said monitoring unit detects a tamper when said counter output in said subsequent transmitted message is substantially different from said expected counter output, said monitoring unit calculating an elapsed time from said tamper by multiplying said counter output by said period t and subtracting said elapsed time from the current time.

8. The method of claim 7 wherein said generating step generates said clock pulses with a period t having a predetermined length to permit continuous observation of said transmitter and the individual by an installing officer, said period t being substantially shorter than time period T so that said counting step counts said clock pulses for at least one said period t following said opening and said closing of said strap during said encircling step so said monitoring unit receives at least one data transmission containing said accumulated count to verify said clock pulses are being counted while the installing officer is observing said transmitter and the individual whereby a subsequent data transmission including said established count substantially different than said expected count within said time period T indicates a tamper with said strap not occurring at installation of said tamper-indicating transmitter about the individual's limb.

9. The tamper-indicating method of claim 7 wherein said time period T is selected to have a predetermined length substantially greater than a time signal t' to permit the continued counting of said clock pulses for a period greater than said time segment t' so that at least one data transmission containing said established count substantially different from said expected count is transmitted upon return of the individual to said monitored area at the expiration of said time segment t', said time segment t' corresponding to an excused time segment for the individual to be outside said monitored area.

10. The tamper-indicating method of claim 9 further including the step of:

selectively adjusting said transmission range of said transmitted data through an antenna, said selective adjusting being performed prior to said conductive strap being encircled about the individual's limb to prevent alteration of said set transmission range without breaking said current path so that said monitored area in which the monitoring unit can detect the individual wearing said tamper-indicating transmitter can be predeterminately selected to conform to the structure in which the individual is housed, but cannot be readjusted by the individual once installed without said strap signal generating means generating a signal indicating said strap is not encircling the individual's limb and thereby causing said monitoring unit to detect a tamper event.

11. The tamper-indicating method of claim 10 wherein said selectively adjusting said transmission range step further includes:

selectively connecting an electrical load to said antenna, said electrical load being mismatched with said antenna to decrease said transmission range of said data radiated through said antenna.

12. The tamper-indicating method of claim 7 wherein said encircling step encircles a conductive strap around the individual's limb to secure said transmitter to the individual; and said strap status signal generating step generates a signal indicative that said conductive strap is not encircling the individual's limb.

13. A home arrest system for detecting tampers with a transmitter strap comprising:

a transmitter securable to the confinee's limb or other body part by a strap connected to said transmitter, said transmitter including a monitor circuit operatively connected to said strap, said circuit generating a strap status signal indicative of whether said strap is closed or open, means for generating clock pulses, means for counting said clock pulses, said counting means being operatively connected to said monitoring circuit and being enabled to count said clock pulses when said strap status signal indicates said strap is closed, said counting means generating a count output corresponding to the number of clock pulses counted by said counting means, said count output beginning at an initial count whenever said counting means is enabled by said monitoring circuit and ending at a final count corresponding to the maximum number of clock pulses that can be counted by said counting means, memory means for storing an identification code, transmitting means for periodically transmitting said identification code stored in said memory means and said count output, said transmitting means having a predetermined transmission range; and a monitoring unit for receiving said identification code and said count output from said transmitter when said monitoring unit is within said transmission range of said transmitter, said monitoring unit including message generating means for generating messages indicative of said strap status and the time of a change in said strap status, said message generating means generating a message indicating said strap is opened whenever said count output is said initial count, said message generating means generating a strap closed, counting message whenever said count output is between said initial count and said final count, said message generating means generating a closed strap, no tamper message whenever said count output is said final count, and sending means for sending said generated messages to a central monitoring station, whereby said monitoring station can determine when said strap is opened and closed and calculate a time of said strap opening or strap closing so that said monitoring unit can generate messages indicative of the transmitter's securement about the confinee's limb to the central monitoring station that can monitor a plurality of said monitoring units.

14. The home arrest system of claim 13 wherein said clock pulse generating means generates clock pulses having a period t, said final count corresponding to the maximum number of clock pulses that can be counted by said counting means defines a time period T, and said period t has a predetermined length to permit continuous observation of said transmitter and the individual by an installing officer for a conveniently short time interval, said period t being extremely short relative to said period T so that said counting means counts from said predetermined initial count following an opening and closing of said strap during the strapping of said strap about the individual's limb so said monitoring unit receives at least one data transmission containing said counter output to verify said counting means is counting said clock pulses while the installing officer is observing said transmitter and the individual, whereby a subsequent data transmission that includes a counter output substantially different than said expected counter output within said time period T indicates a tamper with said strap not occurring as an incident to the installation of said tamper-indicating transmitter about the individual's limb.

15. The home arrest system of claim 14 wherein a monitored area is defined by a radius of said transmission range swept about said monitoring unit, and the length of said time period T is selected to have a predetermined length substantially greater than a time segment t' to permit the continued counting of said clock pulses for a period greater than said time segment t' so that at least one data transmission containing said counter output substantially different from said expected counter output is transmitted upon return of the individual to said monitored area at the expiration of time segment t' if a tamper occurred to said strap, said time segment t' corresponding to an excused time segment for the individual to be outside said monitored area.

16. The home arrest system of claim 13 wherein said transmitter further includes:

means for selectively adjusting said transmission range of said transmitting means, said selectively adjustable transmission range means being inaccessible when said tamper-indicating transmitter is strapped about the individual's limb so that said monitored area in which the monitoring unit can detect the individual wearing said tamper-indicating transmitter can be predeterminately selected prior to installation of the transmitter on the individual's limb to conform to the structure in which the individual is housed, but cannot be readjusted by the individual once installed without said generating means generating a signal indicative of said strap not being secured about the individual's limb and thereby causing said monitoring unit to detect a tamper.

17. The home arrest system of claim 13 wherein said strap of said transmitter is conductive to provide a current path around the individual's limb when said transmitter is secured to the individual; and said generating means generates said strap status signal in response to the electrical continuity of said current path in said conductive strap being interrupted and restored.

18. A tamper-indicating transmitter which can be strapped about an individual's limb or other body part, comprising:

a strap to encircle the individual's limb or other body part and hold said transmitter in close proximity to said limb;

means for generating a strap status signal responsive to tampers to said strap, said strap status signal being indicative of whether said strap is secured about the individual's limb;

a clock for generating clock pulses, each of said clock pulses having a period t;

counting means for counting said clock pulses in response to said strap status signal, said counting means being enabled to count said clock pulses when said strap status signal indicates said strap is not secured about said individual's limb, said counting means providing a counter output corresponding to the number of pulses counted by said counting means at least once each period t;

memory means for storing an identification code; and transmitting means for transmitting data over a predetermined transmission range, said transmitted data including said identification code from said memory means and said counter output of said counting means, said transmitting means transmitting said data at least once within each said period t so that a monitoring unit receiving said transmitted data can determine that the individual to which said tamper-indicating transmitter is strapped is within a monitored area defined by a radius of said transmission range swept about said monitoring unit by comparing said transmitted identification code with a reference identification code equivalent to said identification code stored in said memory and detect said tamper by storing said counter value received in said transmitted message, said monitoring unit compares subsequent counter outputs in said transmitted messages to said stored counter value whereby said monitoring unit detects a tamper when said counter output in said subsequent transmitted message is different from said stored counter output.

19. The tamper-indicating transmitter of claim 18 further including:

means for selectively adjusting said transmission range of said transmitting means, said selectively adjustable transmission range means being inaccessible when said tamper-indicating transmitter is strapped about the individual's limb so that said monitored area in which the monitoring unit can detect the individual wearing said tamper-indicating transmitter can be predeterminately selected prior to installation of the transmitter on the individual's limb to conform to the structure in which the individual is housed, but cannot be readjusted by the individual once installed without said generating means generating a signal indicative of said strap not being secured about the individual's limb and thereby causing said monitoring unit to detect a tamper.

20. The apparatus of claim 19 wherein said transmitting means includes an antenna, and wherein said range transmission adjustment means includes:

means for selectively connecting an electrical load to said antenna to electrically load said transmitting means, said electrical load being mismatched with said antenna to decrease the power of the transmission radiated through said antenna.

21. The tamper-indicating transmitter of claim 18 wherein said strap is conductive to provide a current path around the individual's limb when said transmitter is secured to the individual;

said generating means generates said strap status signal in response to the electrical continuity of said current path in said conductive strap being interrupted and restored.

* * * * *